US007047696B2

(12) United States Patent
DiDomenico

(10) Patent No.: US 7,047,696 B2
(45) Date of Patent: May 23, 2006

(54) GROUND ANCHOR SYSTEM AND METHOD OF INSTALLATION

(76) Inventor: Anthony J. DiDomenico, 951 School St., Collegeville, PA (US) 19426

( * ) Notice: Subject to any disclaimer, the term of this patent is extended or adjusted under 35 U.S.C. 154(b) by 37 days.

(21) Appl. No.: 10/611,155

(22) Filed: Jul. 2, 2003

(65) Prior Publication Data

US 2005/0000170 A1 Jan. 6, 2005

(51) Int. Cl.
*E02D 5/74* (2006.01)

(52) U.S. Cl. ..... 52/166; 52/155; 52/156; 52/158; 52/159

(58) Field of Classification Search ..... 52/155, 52/156, 158, 159, 166
See application file for complete search history.

(56) References Cited

U.S. PATENT DOCUMENTS

| | | | | |
|---|---|---|---|---|
| 1,241,472 | A * | 9/1917 | Adamson | 52/155 |
| 1,550,276 | A * | 8/1925 | Engelbert | 52/158 |
| 1,721,436 | A | 7/1929 | DuBois et al. | |
| 2,870,884 | A | 1/1959 | Mazur | |
| 3,216,159 | A * | 11/1965 | Rooker | 52/158 |
| 3,341,993 | A * | 9/1967 | Lavond et al. | 52/158 |
| 3,425,174 | A * | 2/1969 | Wood | 52/162 |
| 3,500,598 | A * | 3/1970 | Ettinger | 52/155 |
| 4,679,369 | A * | 7/1987 | Kinsley et al. | 52/155 |
| 5,515,656 | A | 5/1996 | Mihalich | |
| 6,735,911 | B1 * | 5/2004 | Alexander | 52/155 |
| 2004/0148877 | A1 * | 8/2004 | Roberts | 52/155 |

* cited by examiner

*Primary Examiner*—Carl D. Friedman
*Assistant Examiner*—Tiara Robertson
(74) *Attorney, Agent, or Firm*—LaMorte & Associates

(57) ABSTRACT

A ground anchoring system and its method of attachment to the ground. The ground anchor device has a base frame with bottom surfaces that terminate in a common plane. A plurality of elongated slots are defined through the base frame. Anchor spikes are provided for extending through the elongated slots of the base frame. Each of the anchor spikes has a flat face surface, a flat rear surface and a predetermined thickness between the face surface and the rear surface that is at least half as wide as the face surface. A tether mount is connected to the base frame. Any tension applied to the tether mount is transferred to the base frame and the anchor spikes extending through the base frame, wherein the tension force acts at a perpendicular to the flat face surface of the anchor spikes.

16 Claims, 4 Drawing Sheets

GROUND ANCHOR SYSTEM AND METHOD OF INSTALLATION

BACKGROUND OF THE INVENTION

1. Field of the Invention

In general, the present invention relates to anchoring systems that engage the ground. More particularly, the present invention relates to portable anchoring systems that can be rapidly set into the ground at any point and removed from the ground when no longer needed.

2. Description of the Prior Art

Having an anchoring point to tie a rope is very useful in countless scenarios, from guying a tree to tying down an airplane. Many times, natural objects, such as trees or rocks, can be used as natural anchors. However, natural occurring anchoring points are not always available where you want them, and when you want them. This is especially true when a particularly strong anchoring point is needed, and a simple stake driven into the ground is insufficient.

In the prior art, portable anchoring systems have been developed that provide strong attachments with the ground. With such prior art devices, a plate is typically provided that contains holes. Spikes are then driven through the holes, thereby joining the plate to the ground. An anchoring mount is provided on the plate for attaching a rope. Such prior art anchoring systems are exemplified by U.S. Pat. No. 2,870,884 to Mazur, entitled Ground Anchor; U.S. Pat. No. 1,721,436 to Dubois, entitled Anchoring Device; and U.S. Pat. No. 5,515,656 to Mihalich, entitled Portable Anchorage And Fastener.

All of the prior art anchoring devices listed above share common drawbacks in design. First, all the cited prior art anchoring systems use round spikes to attach the anchor plates to the ground. Round spikes provide only limited resistance to movement once driven into the ground. If pulled hard enough, round spikes have a tendency to move as they plow through the ground. Second, the amount of anchoring strength provided by the prior art anchoring systems is proportional to the number of spikes used. The more spikes that are used, the larger the anchoring plate has to be in order to accommodate the spikes. Thus, if a large anchoring force is needed, many spikes are needed and a large anchoring plate is required. This makes the prior art anchoring systems very heavy and cumbersome, especially those intended to provide significant anchoring forces.

A need therefore exists for an improved anchoring system that provides stronger attachment to the ground than prior art systems, yet does so without being overly bulky or heavy. This need is met by the present invention as described and claimed below.

SUMMARY OF THE INVENTION

The present invention is a ground anchoring system and its method of attachment to the ground. The ground anchor device has a base frame with bottom surfaces that terminate in a common plane. A plurality of elongated slots are defined through the base frame. Anchor spikes are provided for extending through the elongated slots of the base frame. Each of the anchor spikes has a flat face surface, a flat rear surface and a predetermined thickness between the face surface and the rear surface that is at least half as wide as the face surface.

A tether mount is connected to the base frame. Any tension applied to the tether mount is transferred to the base frame and the anchor spikes extending through the base frame, wherein the tension force acts at a perpendicular to the flat face surface of the anchor spikes.

The base frame itself can be foldable or collapsible. This enables the base frame of the ground anchor to be stored in a compact manner when not in use.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention anchoring system can be used on sand, gravel and other such surfaces, it is particularly well suited for use on earthen ground. Accordingly, in the illustrated embodiments, the present invention anchoring system will be described as being used on earthen ground in order to set forth the best mode contemplated for the use of the invention.

Figure 1:
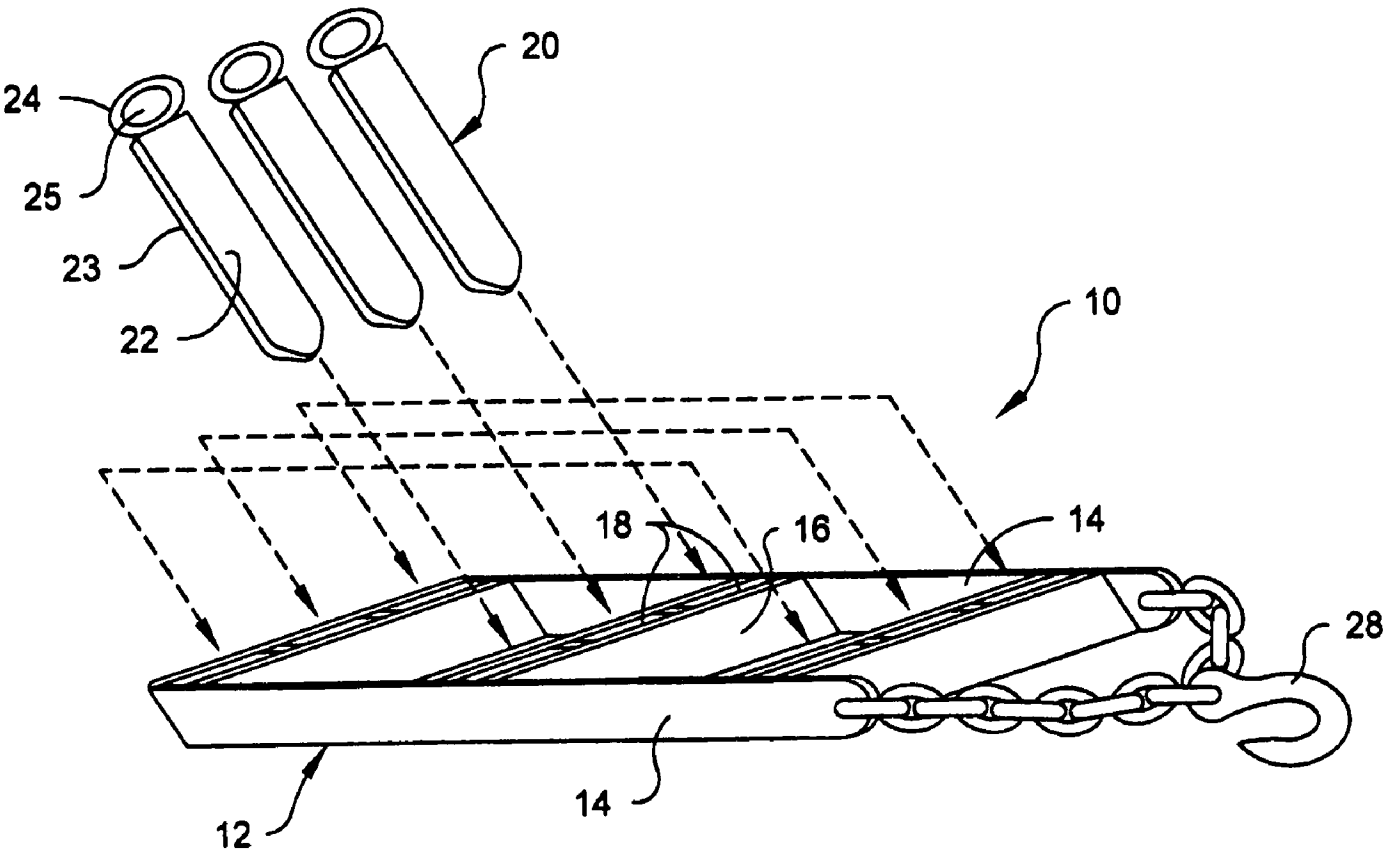
FIG. 1 is a perspective view of an exemplary embodiment of the present invention anchoring system.

Referring to FIG. 1, it can be seen that the present invention anchoring system 10 has a base frame 12. The base frame 12 is placed on the ground where the anchoring system 10 is to be anchored to the ground. The base frame 12 has a plurality of lateral bar elements 14 that are made from a strong metal, such as steel. The lateral bar elements 14 are spaced apart from each other creating the sides of an open framework. In the shown embodiment, two lateral bar elements 14 are provided. Thus, there is only one space between the two lateral bar elements 14. Such an embodiment is merely exemplary, and it should be understood that three, four or any number of lateral bar elements 14 can be used, wherein a space would exist between each of the lateral bar elements 14.

Slotted crossbar elements 16 extend between adjacent lateral bar elements 14. Each of the slotted crossbar elements 16 defines at least one slot 18 that extends through the slotted crossbar element 16. In the shown embodiment, three slots 18 are formed in each of the slotted crossbar elements 16. Such a number is arbitrary and it will be understood that one slot, or any number of slots can be provided.

The number of slots 18 that can be provided in a slotted crossbar element 16 is controlled by the length of the slotted crossbar element 16. Each slot 18 must provide enough room to enable a flat anchor spike 20 to pass through the slot 18. Accordingly, each of the slots 18 is rectangular in shape, having a long face edge, a long rear edge and two short side edges.

The flat anchor spikes 20 have a generally rectangular cross-sectional shape. Each flat anchor spike 20 has a flat face surface 22 and a flat back surface 23. The thickness of each flat anchor spike 20 is at least 50 percent smaller than the width of the flat face surface 22 or the back surface 23. Preferably, the flat anchor spikes 20 are made of steel and have a cross width of between two inches and five inches.

The length of the flat anchor spikes 20 is preferably between six inches and eighteen inches. However, in soft soil or sand, longer lengths can be used.

An annular head 24 is attached to the top of the planar body of the flat anchor spikes 20. The annular head 24 defines a central opening 25. This central opening 25 can be engaged by the end of a pickaxe, pole or other elongated tool and greatly increases the ease with which the flat anchor spikes 20 can be pried up and out of the ground. The head 24 of the flat anchor spikes 20 cannot pass through the slots 18 in the base frame 12.

Figure 2:
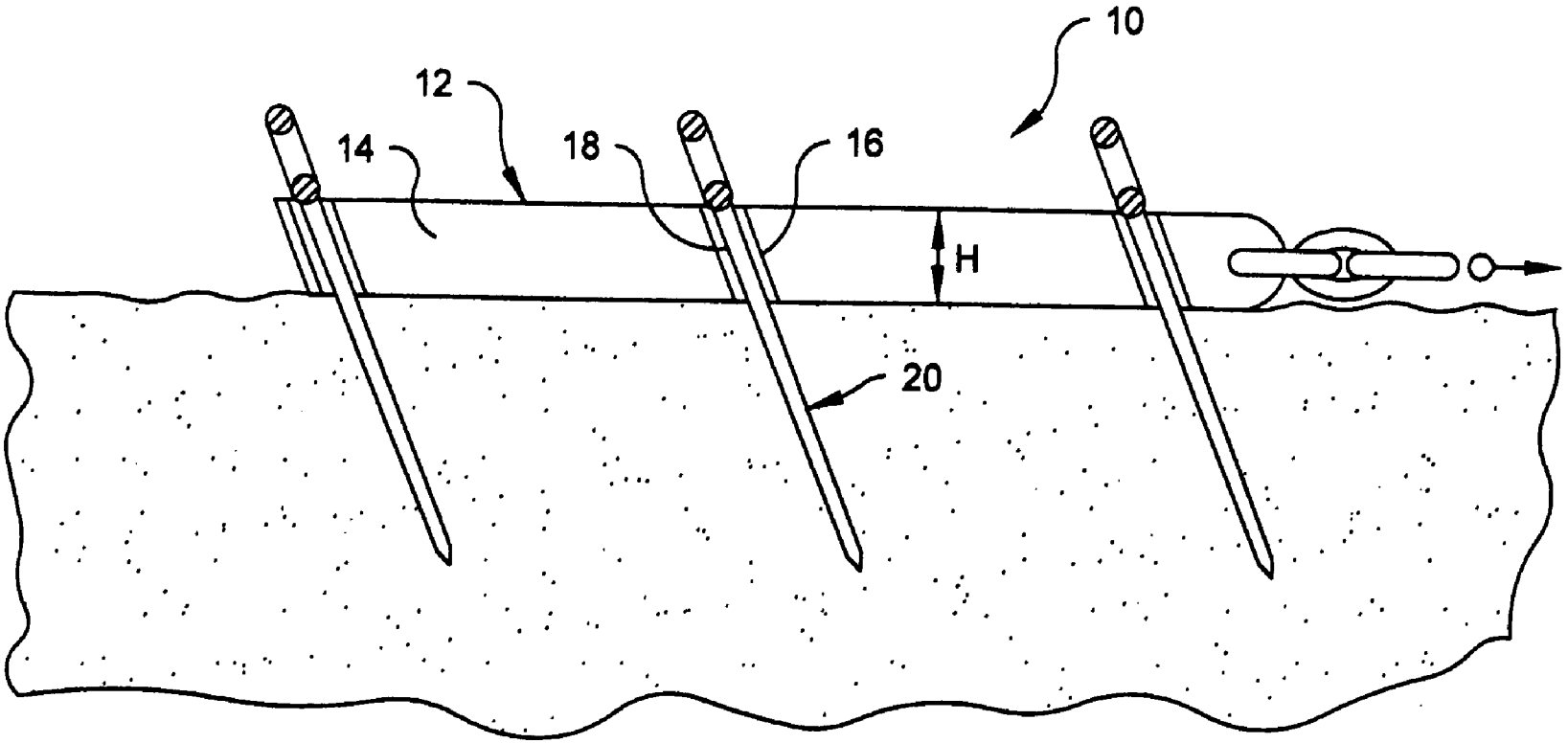
FIG. 2 is a cross-sectional view of the embodiment of FIG. 1 shown engaging the ground.

Referring to FIG. 2 in conjunction with FIG. 1, it can be seen that the bottoms of the lateral bar elements 14 and the bottoms of the slotted crossbar elements 16 all terminate in a common plane. It can also be seen that the slots 18 in the slotted crossbar elements 16 do not run vertically. Rather, the slots 18 are tilted at an angle of between ten degrees and forty-five degrees with respect to the common plane of the bottom of the base frame 12. The slant of the slots 18 guides the flat anchor spikes 20 into the ground at the same angle. Accordingly, when all the flat anchor spikes 20 are set into place in the slots 18, the underground sections of all the flat anchor spikes 20 are tilted forward toward the front of the base frame 12.

By slanting the flat anchor spikes 20 forward, the flat anchor spikes 20 are provided with greater strength in resisting forward movement in the earth without bending. Furthermore, since the flat anchor spikes 20 are generally flat, they provide a wide face surface that requires a great force to be pulled forward and plowed through the earth. Each flat anchor spike 20 provides more than twice as much resistance to forward movement than does a traditional round spike of the same cross-sectional area. However, since the flat anchor spikes are generally flat, the cross-sectional area of the flat anchor spikes 20 need not be greater than that of a round spike. Accordingly, the flat anchor spikes 20 are just as easy to drive into the ground, as would be a round spike.

Referring now solely to FIG. 2, it can be seen that both the lateral bar elements 14 and the slotted crossbar elements 16 extend a height H above the common bottom plane. This height H is preferably longer than one inch. By providing a height of at least one inch. There is significant surface-to-surface contact between the interior of the slots 18 in the slotted crossbar elements 16 and the sides of the flat anchor spikes 20. Furthermore, the taller the base frame 12, the taller the joints are between the lateral bar elements 14 and the slotted crossbar elements 16. This adds strength to the slotted crossbar elements 16 that prevents the slotted crossbar elements 16 from twisting when the flat anchor spikes 20 are in the ground and a significant force is applied to the base frame 12.

In the embodiment of FIG. 1 and FIG. 2, there are three crossbar elements 16, wherein each crossbar element 16 holds three flat anchor spikes 20. As such, the shown anchor can hold nine flat anchor spikes 20. However, such a configuration is exemplary. As has already been explained, any number of crossbar elements 16 can be used and each crossbar element 16 can be configured to hold any number of flat anchor spikes 20. Of course, the more flat anchor spikes 20 that are used, the more resistance to movement is provided and the stronger the ground anchor system 10 becomes.

In FIG. 1, it can be seen that a hook 28 is attached to the front of the base frame 12. The hook 28 provides a mechanism by which the base frame 12 can be attached to a rope, chain or other object that needs to be anchored. The hook 28 is merely exemplary and it should be understood that any other form of a tether mount can be used. The hook 28 is connected to the base frame 12 so that any tension force applied to the hook 28 will be transferred to the base frame 12 and the anchor spikes 20 so that the tension force acts at a perpendicular to the flat face surface of each anchor spike 20.

It will be understood that the strength of the ground anchor system 10 depends largely upon the number of flat anchor spikes 20 that are used. However, the more flat anchor spikes 20 that are to be used, the larger the base frame 12 is required to be. In order to reduce the bulk of the base frame 12 and to increase the mobility of the base frame 12, the base frame 12 can be made to be foldable.

Figure 3:
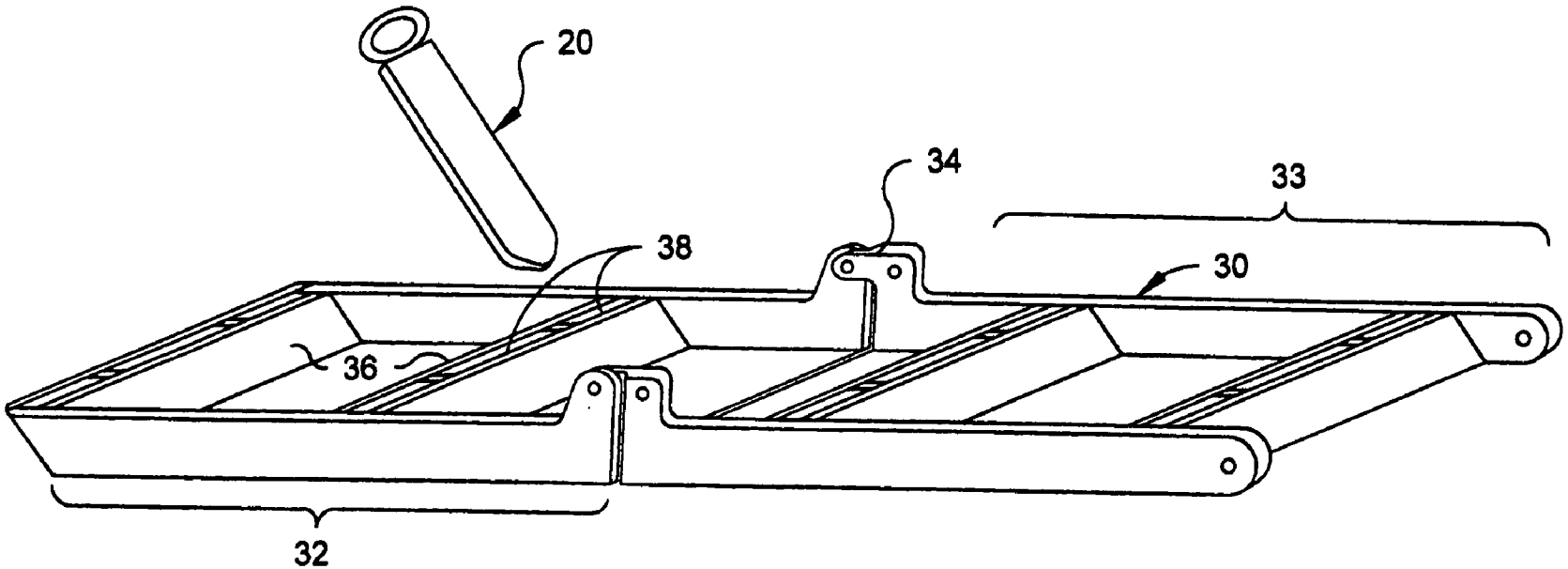
FIG. 3 is perspective view of a second embodiment of the present invention anchoring system.

Referring to FIG. 3, an alternate embodiment of a ground anchor base frame 30 is shown, wherein the base frame is foldable. The base frame of the ground anchor has two sections 32, 33 that are joined together by a hinge 34. As such, the first section 32 and the second section 33 of the base frame 30 can be folded against each other when the base frame 30 is being stored.

Each section of the base frame 30 contains crossbar elements 36 that define slots 38 for flat anchor spikes 20. Flat ground anchor spikes 20 pass through these slots 38 and connect the base frame 30 to the ground in the manner previously described.

In the shown embodiment, only one hinge joint 34 is shown that allows the base frame 30 to be folded in half. It will be understood that more than one hinge joint can be used, therein producing a base frame that can be folded in thirds, fourths or any other configuration.

Figure 4:
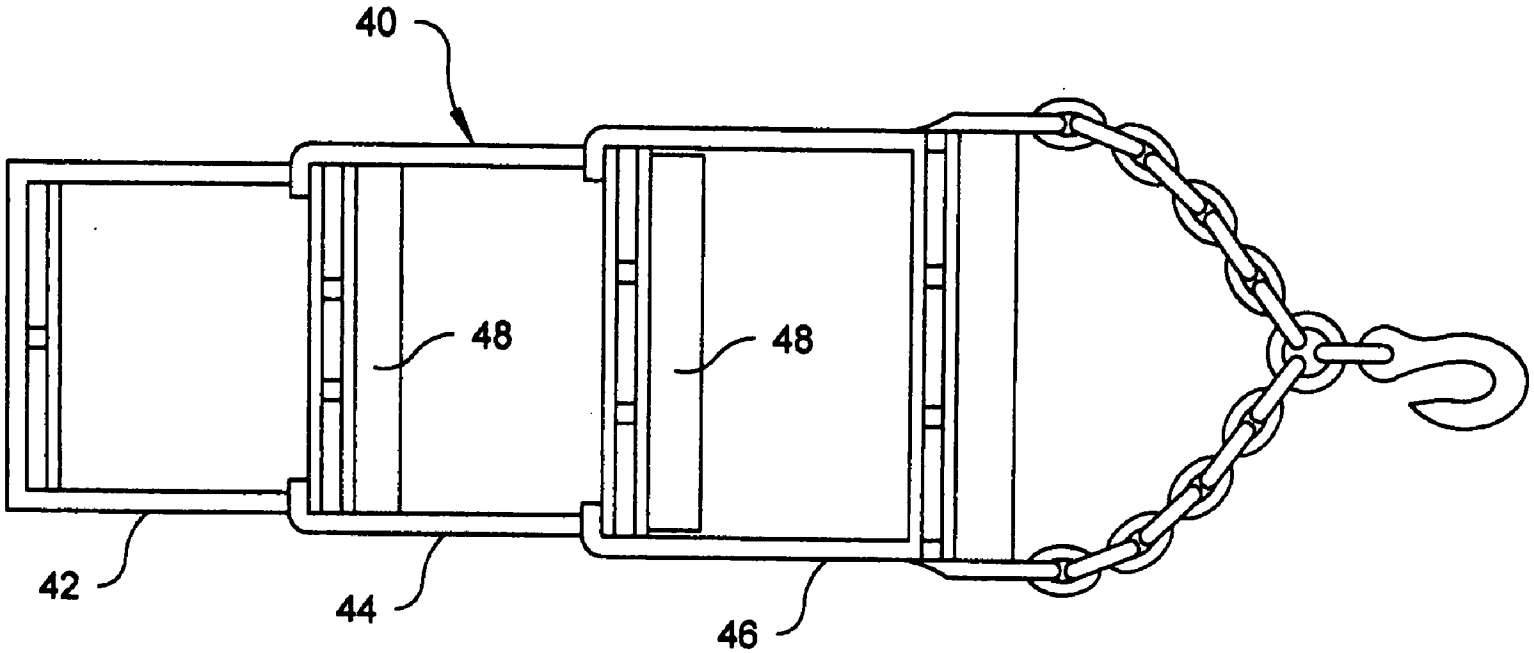
FIG. 4 is an exemplary embodiment of a third embodiment of the present invention anchoring system.

There are configurations, other than folding, that can be used to make the base frame more compact when not in use. Such an alternate configuration is shown in FIG. 4. In FIG. 4, a telescoping base frame 40 is shown. In this embodiment, there are pluralities of rigid frame elements 42, 44, 46 that engage one another in a telescoping manner. Each of the rigid frame elements 42, 44, 46 contains at least one crossbar element 48 that receives flat anchor spikes. In the shown embodiment, each of the rigid fame elements 42, 44, 46 is a different size, wherein there is a first large frame element 42, a last small frame element 46 and an intermediate medium frame element 44. Each of these rigid frame elements 42, 44, 46 engages the other with a sliding telescopic connection. Accordingly, the last small frame element 46 can pass into the interior of the medium frame element 44 and the medium frame element 44 can pass into the interior of the large frame element 42 when the ground anchor is being stored.

It will be understood that the embodiments of the present invention ground anchor system that are described and illustrated herein are merely exemplary and a person skilled in the art can make many variations to the embodiment shown without departing from the scope of the present invention. For example, the flat anchor spikes can be varied in length, width and number. The base frame can be configured to hold any number of flat anchor spikes and can be made either rigid or collapsible for storage. All such variations, modifications and alternate embodiments are intended to be included within the scope of the present invention as defined by the appended claims.

What is claimed is:

1. A ground anchor device, comprising:

a base frame having lateral bar elements and crossbar elements that extend between adjacent lateral bar elements, wherein said lateral bar elements and said crossbar elements have bottom surfaces that terminate in a common plane, wherein said base frame is configurable between a folded configuration and an extended configuration;

a plurality of rectangular slots defined by said base frame, wherein said rectangular slots are disposed in said crossbar elements and extend through said bottom surfaces; and a plurality of anchor spikes for extending through said rectangular slots, each of said anchor spikes having a flat face surface, a flat rear surface and a predetermined thickness between said face surface and said rear surface, wherein said face surface has a width at least twice as wide as said predetermined thickness, and wherein said anchor spikes are driven into the ground through said plurality of rectangular slots in said base frame when said base frame is in said extended configuration.

2. The ground anchor according to claim 1, wherein each of said slots extends up from said bottom surfaces at an acute angle with respect to said common plane in which said bottom surfaces terminate.

3. The ground anchor according to claim 1, wherein each of said slots extends at least one inch through said base frame.

4. The ground anchor according to claim 1, wherein said base frame has at least two sections that are joined by a hinge, wherein said at least two sections of said base frame can be selectively folded about said hinge.

5. The ground anchor according to claim 1, wherein said base frame has at least a first section and a second section that telescopically expand in relation to each other.

6. The ground anchor according to claim 1, further including a tether mount coupled to said base frame, wherein a tension force applied to said tether mount acts at a perpendicular to said face surface of each of said anchor spikes.

7. The ground anchor according to claim 1, wherein each of said anchor spikes has an enlarged head that cannot pass through said slots in said base frame.

8. The ground anchor according to claim 7, wherein each said enlarged head is annular, therein defining a central opening.

9. A ground anchor system, comprising:

a plurality of anchor spikes, wherein each said anchor spike has a flat face surface;

a base frame that is configurable between a folded configuration and an extended configuration, said base frame having parallel crossbar elements with bottom surfaces that terminate in a common plane, wherein a plurality of elongated slots extend through said crossbar elements, wherein said plurality of slots are uniform in shape and orientation, having shapes that receive said anchor spikes and enable said anchor spikes to pass through said base frame.

10. The system according to claim 9, wherein each of said anchor spikes has a flat rear surface and a predetermined thickness between said face surface and said rear surface, wherein said face surface has a width at least twice as wide as said predetermined thickness.

11. The system according to claim 9, wherein each of said slots extends up from said bottom surfaces at an acute angle with respect to said common plane in which said bottom surfaces terminate.

12. The system according to claim 9, wherein each of said slots extends at least one inch through said base frame.

13. The system according to claim 9, wherein said base frame has of at least two sections that are joined by a hinge, wherein said at least two sections of said base frame can be selectively folded about said hinge.

14. The system according to claim 9, wherein said base frame has at least one first section and a second section that telescopically expand in relation to each other.

15. The system according to claim 9, wherein each of said anchor spikes has an enlarged head that cannot pass through said slots in said base frame.

16. A ground anchor device, comprising:

a base frame having bottom surfaces that terminate in a common plane, wherein said base frame has at least a first section and a second section that telescopically expand in relation to each other so that said base frame is configurable between a folded configuration and an extended configuration;

a plurality of rectangular slots defined by said base frame, wherein said rectangular slots extend through said bottom surfaces; and a plurality of anchor spikes for extending through said rectangular slots, each of said anchor spikes having a flat face surface, a flat rear surface and a predetermined thickness between said face surface and said rear surface, wherein said face surface has a width at least twice as wide as said predetermined thickness, and wherein said anchor spikes are driven into the ground through said plurality of rectangular slots in said base frame when said base frame is in said extended configuration.

* * * * *